US006901985B2

(12) United States Patent
Eckart

(10) Patent No.: US 6,901,985 B2
(45) Date of Patent: Jun. 7, 2005

(54) TAPING DEVICE

(75) Inventor: Hubert Eckart, Fulda (DE)

(73) Assignee: Wella AG, Darmstadt (DE)

( * ) Notice: Subject to any disclaimer, the term of this patent is extended or adjusted under 35 U.S.C. 154(b) by 0 days.

(21) Appl. No.: 10/483,320

(22) PCT Filed: Jul. 13, 2002

(86) PCT No.: PCT/EP02/07815

§ 371 (c)(1),
(2), (4) Date: Jan. 7, 2004

(87) PCT Pub. No.: WO03/010780

PCT Pub. Date: Feb. 6, 2003

(65) Prior Publication Data

US 2004/0188028 A1 Sep. 30, 2004

(30) Foreign Application Priority Data

Jul. 21, 2001 (DE) ..... 201 12 040

(51) Int. Cl.[7] ..... B65H 81/08

(52) U.S. Cl. ..... 156/392; 156/428; 156/522; 156/579; 242/442

(58) Field of Search ..... 156/195, 391, 156/392, 425, 428, 429, 468, 486, 510, 522, 574, 577, 579; 100/13, 27; 242/441.2, 441.3, 442

(56) References Cited

U.S. PATENT DOCUMENTS

| | | | | | |
|---|---|---|---|---|---|
| 3,374,615 | A | * | 3/1968 | Evanicsko, Jr. | 242/441.3 |
| 4,097,321 | A | * | 6/1978 | Kelly et al. | 156/136 |
| 4,346,550 | A | * | 8/1982 | Ferree | 57/10 |
| 4,790,896 | A | * | 12/1988 | Schmalholtz | 156/392 |
| 5,271,791 | A | * | 12/1993 | Tanaka | 156/468 |
| 5,417,787 | A | * | 5/1995 | Tanaka | 156/187 |
| 5,573,627 | A | * | 11/1996 | Vuong | 156/392 |

FOREIGN PATENT DOCUMENTS

| | | |
|---|---|---|
| DE | 14 65 995 A | 5/1969 |
| FR | 2 188 266 A | 1/1974 |

* cited by examiner

*Primary Examiner*—James Sells
(74) *Attorney, Agent, or Firm*—Michael J. Striker

(57) ABSTRACT

A manually-powered taping tool for taping an elongated object with tape, which consists of a radial bearing ring (5) provided with a cutout (7) of sufficient size so that the object can pass into the cutout (7); an inner part (6) rotatably mounted within the radial bearing ring (5), which has a radial recess (8) corresponding to the cutout (7); a centrally disposed tape holder (9) mounted on one side of the inner part (6) transverse to the recess (8); a pendulum bearing (10) pivotally connecting the tape holder (9) with the inner part (6); a tape-severing device (14) arranged in tie vicinity of the cutout (7) and a handle (11) or a stationary stand (12) rigidly attached to the radial bearing ring (5).

8 Claims, 6 Drawing Sheets

TAPING DEVICE

BACKGROUND OF THE INVENTION

The invention relates to a taping device for taping an elongated object with tape from a spool of tape.

For protection against mechanical and thermal stress, as EMC protection and/or for reducing vibration noises, cable harnesses in bicycles, passenger cars, trucks, buses, airplanes, and sometimes in machines are sheathed with tape wound helically around the cords. This tape can be adhesive or nonadhesive. This process is predominantly done today by hand without tools, or with either stationary or semistationary taping devices with an additional drive mechanism.

SUMMARY OF THE INVENTION

The object of the invention is to create a device of this same generic type that without a motor-type drive mechanism makes simple, ergonomic, fast, uniform taping of elongated objects possible and is compact and can be produced economically.

According to the invention the device for taping an elongated object with tape from a spool of tape comprises a radial bearing ring provided with a radially extending cutout of sufficient size so that the elongated object can pass into it;

an inner part rotatably mounted in the radial bearing ring, which is provided with a radial recess corresponding to the cutout;

an approximately centrally disposed tape holder for the spool of tape, which is mounted across from the recess;

a pendulum bearing connecting the approximately centrally disposed tape holder with the rotatable inner part; and either a handle rigidly attached to the bearing ring so that the device is hand-held or a stationary stand rigidly attached to the bearing ring.

In preferred embodiments of the taping device a tape-severing device is arranged in the vicinity of the cutout, preferably attached to the radial bearing ring at the edge of the cutout.

In various embodiments of the invention the rotatable inner part has an outer peripheral edge and comprises a plurality of bearing rollers distributed uniformly around the outer peripheral edge and the inner part is rotatably mounted in the radial bearing ring by means of these bearing rollers.

BRIEF DESCRIPTION OF THE DRAWING

The objects, features and advantages of the invention will now be described in more detail with the aid of the following description of the preferred embodiments, with reference to the accompanying figures in which:

FIG. 1, in a side view, shows a device 1 for taping elongated objects 2 by means of a tape 3 from a spool of tape 4. The device 1 has a radial bearing ring 5, in which a rotatable inner part 6 is supported. The radial bearing ring 5 is provided with a cutout 7, and the inner part 6 is provided with a radial recess 8. The inner part 6, on one side, has an approximately centrally disposed tape holder 9, which is connected transversely to the recess 8 to a pendulum bearing 10. The inner part 6 is provided with radially disposed bearing rollers 16 at equal intervals, and as a result free rotation can be done, including via the cutout 7 of the radial bearing ring 5. The radial bearing ring 5 is connected selectively to a handle 11 and/or a stationary stand 12.

FIG. 2, in a section taken along the line II—II in FIG. 1, shows the device 1, and in this view the disposition of the pendulum bearing 10 is especially clearly shown.

Figure 1:
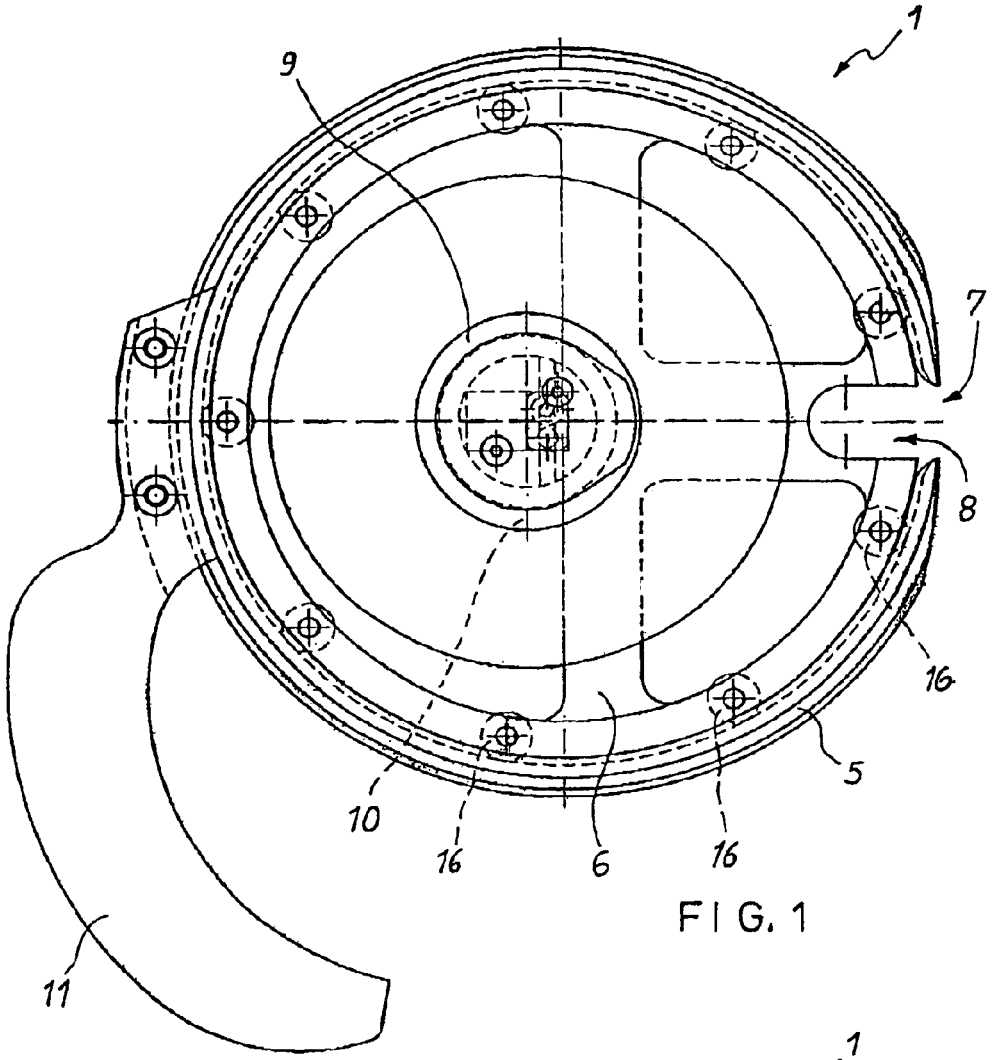
FIG. 1 is vertical cross-sectional view through a first embodiment of a hand-operated taping device according to the invention.
Figure 2:
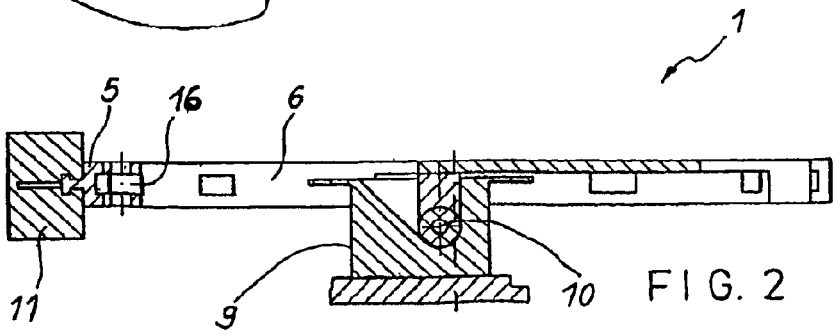
FIG. 2 is a transverse cross-sectional view through the taping device shown in FIG. 1.
Figure 3:
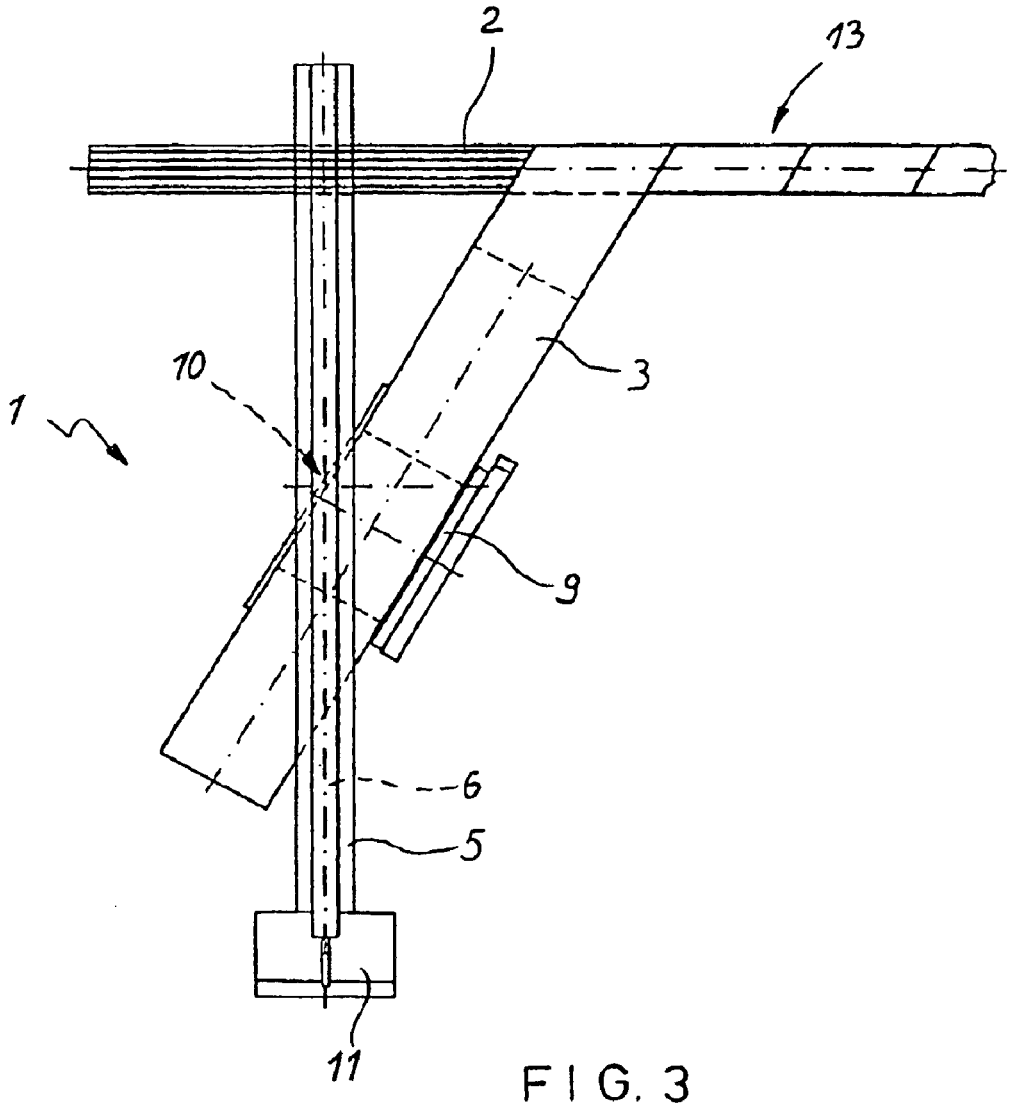
FIG. 3 is a top plan view showing the taping device of FIG. 1 in operation.

A plan view on the device 1 of FIG. 1 is shown in FIG. 3; here, the device 1 is shown in a working position of a taping operation.

Figure 4:
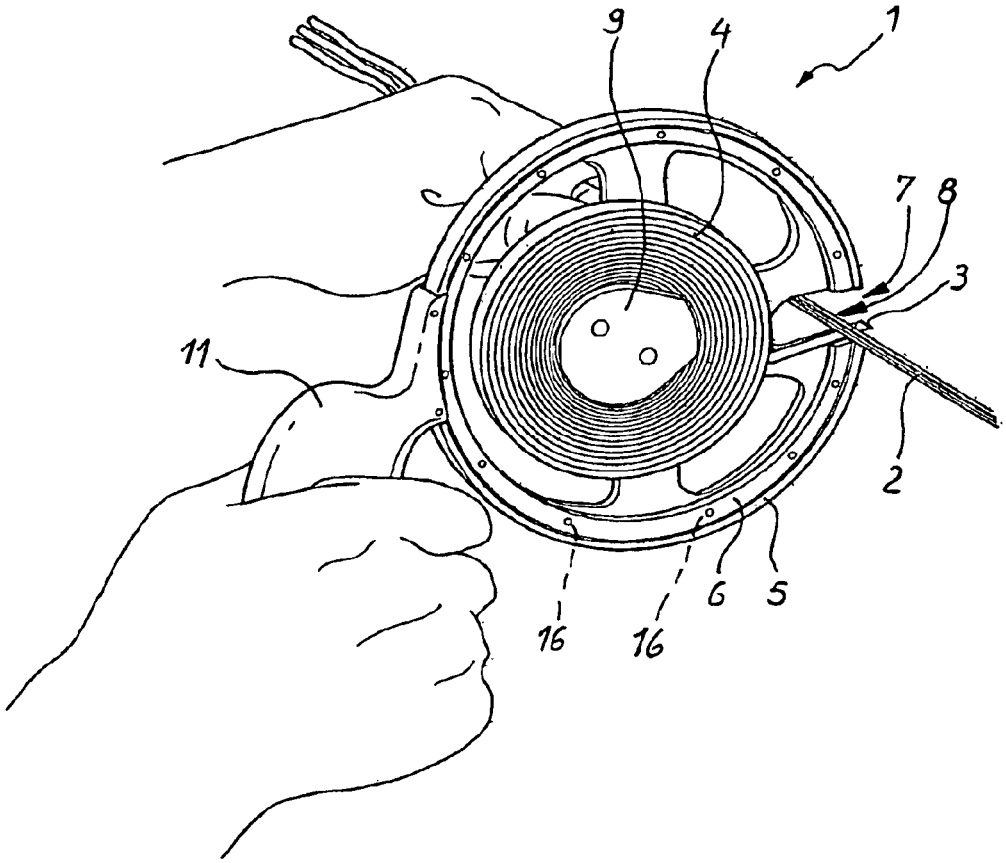
FIGS. 4, 5 and 6 are successive perspective action views showing the taping device of FIG. 1 in operation.

A corresponding recess 8 is made in the inner part 6, and the cable harness 2 is introduced into this recess via the cutout 7 of the radial bearing ring 5 and connected to a leading end of an adhesive side of the tape 3 (FIG. 4).

By means of the device 1, the spool of tape 4 is now passed around the elongated objects 2, or around a cable harness or other elongated product. The motion of the spool of tape 4 is attained by providing that a user guides the device 1 in a circular motion using a handle 11. The circular motion is executed without interruption outside the cable harness 2. With the handle, the circular radial bearing ring 5 secured to it is moved, in which the rotatable inner part 6 is supported in such a way as to move smoothly and is thereby set into rotation by the cable harness 2 located in the recess 8 (FIGS. 4–6).

A bandage 13 is created by the fact that the inner part 6 rotates about the cable harness 2 as a result of the circular motion of the radial bearing ring 5, and thus the spool of tape 4 is passed along a circular arc about the cable harness 2. Once the tape 3 is firmly secured to the cable harness at the beginning of the bandage 13, the tape 3 peels off from the spool of tape 4 upon motion of the device 1 and simultaneously attaches to the cable harness 2. If in this motion the user also executes a longitudinal motion along the cable 2 (FIGS. 5 and 6), a bandage 13 on the cable harness 2 is created. The speed and the slope of the bandage 13 are determined by the user.

So that the tape 3 will be wound into the bandage on the cables 2 without creases, the tape 3 is placed on a tape holder 9 that is pivotably supported by means of the pendulum bearing 10. As a result of the unrolling or drawing-off tension of the tape 3, the tape 3 automatically positions itself obliquely in the slope direction and thus makes it possible to adapt the tape travel direction with the desired slope.

Figure 5:
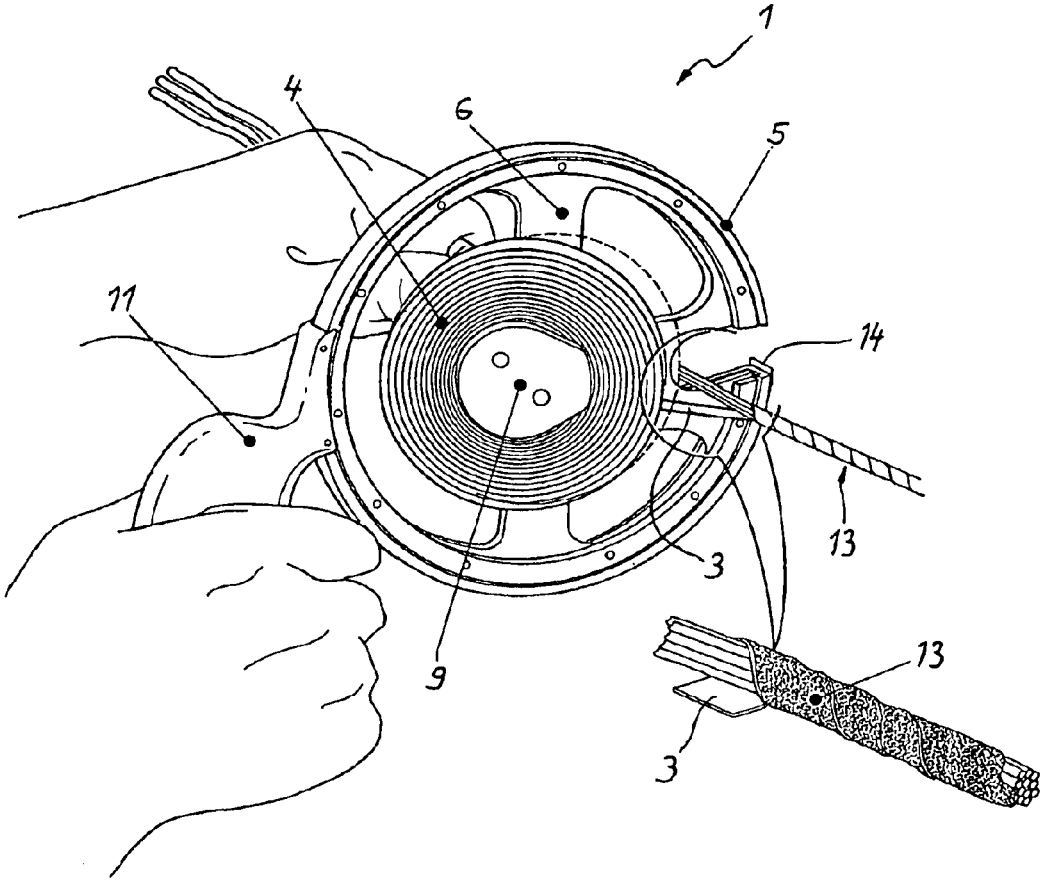
Figure 6:
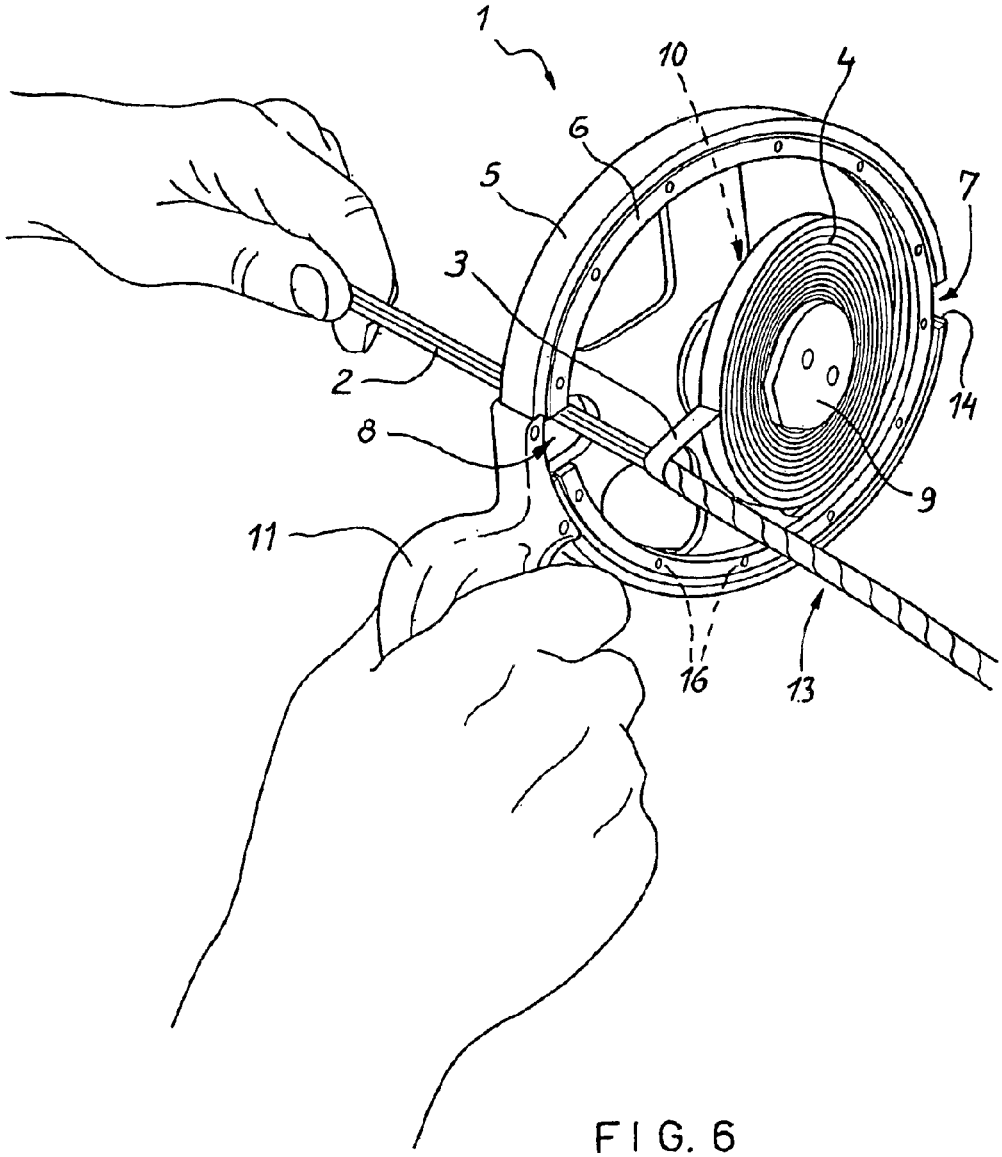
Figure 7:
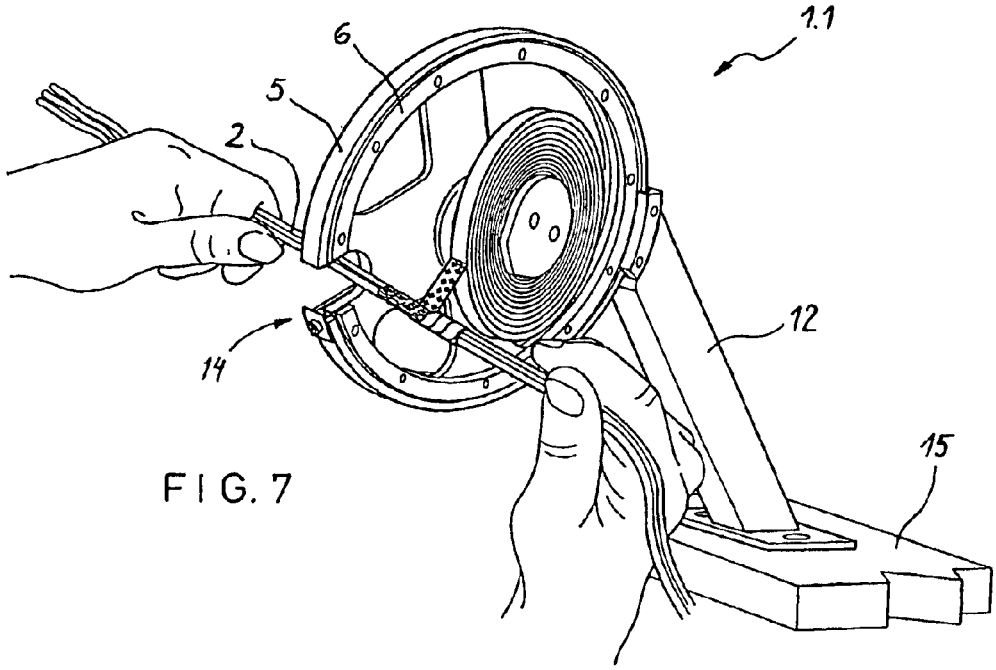
FIGS. 7 and 8 are successive perspective action views showing a second embodiment of the taping device according to the invention in operation.

For cutting the tape 3 after the taping operation is ended, a tape severing device 14 is mounted on the outside of the radial bearing ring 5 (FIG. 5). By means of a suitable motion of the device 1, the tape 3 can be severed immediately next to the cable harness 2 quickly and simply at the end of the bandage 13. At the same time, the tape 3 is again in an optimal starting position (FIG. 4) in which it is ready for the beginning of the next winding operation.

Because of the modular design of the device 1, the individual components, such as the handle 11, inner part 6, tape severing device 14 and spool of tape 4, can be mounted in any required position, so that the device 1 can be used universally by both left-handed and right-handed people and for a bandage direction from right to left and vice versa.

Figure 8:
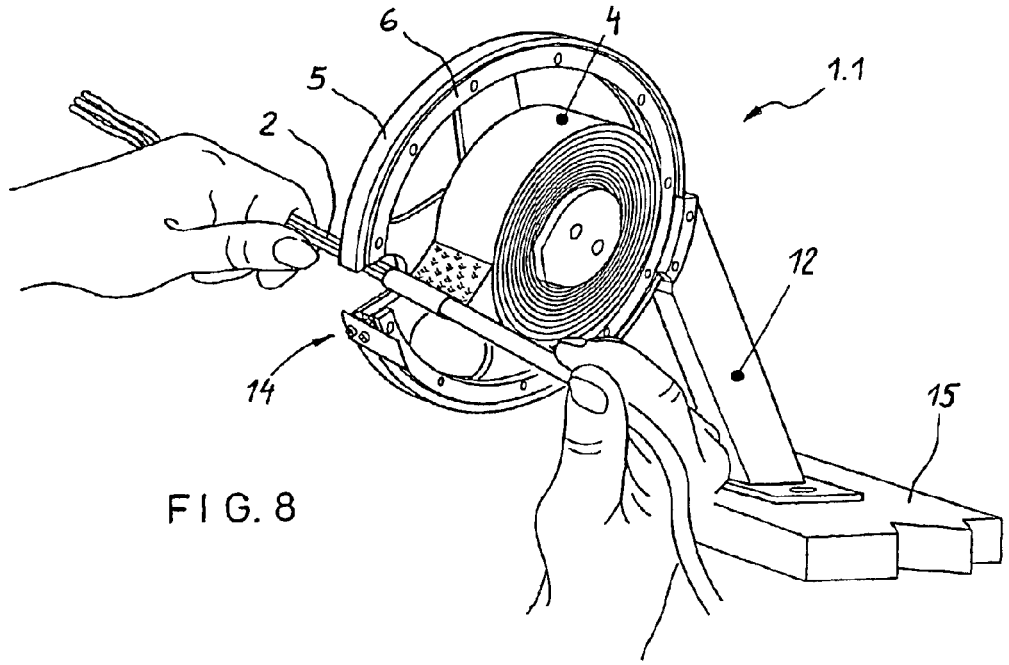

In a second exemplary embodiment, it is provided that the device 1.1 is operated in stationary fashion, by means of a stand 12 on a table 15 or the like (FIG. 8). Then, the circular motion with the objects 2 to be wrapped should be executed by the user with a longitudinal motion (axial motion). In a special application, for instance for insulating a certain area from electrical connections, the stationary device 1.1, with a tape that is for instance 30 to 50 mm wide, can be used without an axial motion of the cable harness 2. High electrical voltage strength is achieved by means of a two- to four-layer wrapping with adhesive tape 3.

Compared to a manual bandage without tools, the device 1, 1.1 is more ergonomic, faster, and more uniform. It effectively prevents well-known occupational diseases of users and increases their output. At the same time, the surface quality of the bandage 13 is improved, and it is easier for the user to maintain the required slope or overlap.

List of Reference Numerals

1, 1.1 Device
2 Objects
3 Tape
4 Spool of tape
5 Radial bearing ring
6 Inner part
7 Cutout
8 Recess
9 Tape holder
10 Pendulum bearing
11 Handle
12 Stand
13 Bandage
14 Tape severing device
15 Table
16 Bearing roller

What is claimed is:

1. A device for taping elongated objects with tape from a spool of tape, said device (1) comprising a radial bearing ring (5) provided with a cutout (7);

a rotatable inner part (6) rotatably mounted in the radial bearing ring, said inner part (6) being provided with a radial recess (8);

an approximately centrally disposed tape holder (9) for the spool of tape, said centrally disposed tape holder (9) being mounted across from the recess (8);

a pendulum bearing (10) connecting the approximately centrally disposed tape holder (9) with the rotatable inner part (6); and either a handle (11) or a stationary stand (12), to which the radial bearing ring (5) is attached, so that the device for taping can either be held and manipulated by hand or supported by the stationary stand during operation.

2. The device as defined in claim 1, further comprising a tape-severing device (14) arranged in the vicinity of the cutout (7).

3. The device as defined in claim 1, wherein the rotatable inner part (6) comprises a plurality of bearing rollers (16) uniformly distributed circumferentially and the rotatable inner part (6) is rotatably mounted in the radial bearing ring (5) by means of said bearing rollers (16).

4. A hand-powered taping tool for taping an elongated object with tape from a spool of tape, said taping tool consisting of a handle (11) or a stationary stand (12);

a radial bearing ring (5) rigidly attached to said handle (11) or said stationary stand (12), said radial bearing ring being provided with a cutout (7) of sufficient size so that said elongated object can pass into the cutout (7);

a rotatable inner part (6) rotatably mounted within said radial bearing ring (5), said rotatable inner part (6) being provided with a radial recess (8) corresponding to said cutout (7);

a centrally disposed tape holder (9) for the spool of tape, said tape holder (9) being mounted on one side of the rotatable inner part (6) transverse to said recess (8);

a pendulum bearing (10) connecting the approximately centrally disposed tape holder (9) with the rotatable inner part (6); and a tape-severing device (14) arranged in the vicinity of the cutout (7).

5. The taping tool as defined in claim 4, wherein the rotatable inner part (6) has a circular outer peripheral edge and comprises a plurality of bearing rollers (16) distributed uniformly around the circular outer peripheral edge and the rotatable inner part (6) is rotatably mounted in the radial bearing ring (5) by means of said bearing rollers (16).

6. The taping tool as defined in claim 4, wherein said tape-severing device (14) is attached to the radial bearing ring (5) at said cutout (7).

7. The taping tool as defined in claim 4, including said handle (11) so as to be hand-held and manipulated by hand during operation.

8. The taping tool as defined in claim 4, including said stationary stand (12).

* * * * *